United States Patent [19]

Bassinger

[11] 4,054,180

[45] Oct. 18, 1977

[54] IMPACT DRILLING TOOL HAVING A SHUTTLE VALVE

[75] Inventor: Grey Bassinger, San Antonio, Tex.

[73] Assignee: Reed Tool Company, Houston, Tex.

[21] Appl. No.: 656,283

[22] Filed: Feb. 9, 1976

[51] Int. Cl.[2] ..... B25D 9/00

[52] U.S. Cl. ..... 173/136; 173/73; 173/80

[58] Field of Search ..... 173/135, 136, 73, 80; 91/319, 320, 299, 302

[56] References Cited

U.S. PATENT DOCUMENTS

| | | | |
|---|---|---|---|
| 2,177,391 | 10/1939 | Lear | 91/302 |
| 2,443,894 | 6/1948 | Craze | 91/302 |
| 2,604,073 | 7/1952 | Nast | 91/302 |
| 3,866,746 | 2/1975 | Curington | 173/80 |
| 3,955,478 | 5/1976 | Feucht | 92/85 B |
| 3,970,152 | 7/1976 | Harris et al. | 173/73 |

*Primary Examiner*—Robert A. Hafer

*Attorney, Agent, or Firm*—Neal J. Mosely

[57] ABSTRACT

An impact drilling tool for rotary drilling which includes a reciprocating hammer inside a casing for striking the top of an anvil. A drilling bit is connected to the opposite end of the anvil for cutting into the earth's formations. The casing is connected in a string of drilling pipe through which a high pressure fluid flows for operating the hammer and removing cuttings. A feeder means extends through the hammer for alternately directing the high pressure fluid above and below the hammer which high pressure fluid causes the reciprocating motion of the hammer. A shuttle valve located around the feeder maintains communication of the high pressure fluid above the hammer for increased effective stroke to insure a harder driving action of the hammer against the anvil. Also the shuttle valve insures a more complete exhaust above the hammer which reduces the force needed to raise the hammer. In alternative embodiments, the shuttle may control only one of the exhaust or pressurization functions.

17 Claims, 14 Drawing Figures

IMPACT DRILLING TOOL HAVING A SHUTTLE VALVE

BACKGROUND OF THE INVENTION

This invention relates to an impact drilling tool and, more particularly, to a pneumatically actuated impact drilling tool for rotary drilling having a center feeder with a shuttle valve located thereon for causing reciprocating action of a hammer against an anvil to create an impact force on a drill bit.

The present invention is an improvement over U.S. patent application Ser. No. 507,968 filed on Sept. 20, 1974 and has the same inventor and assignee as the present invention, which patent application is hereby incorporated by reference.

In alternative embodiments, the present invention may be used to modify existing pneumatic drilling tools to increase their effectiveness by shifting the valving position of at least one of their pressurization or exhaust functions, above or below the hammer. A typical example can be found in the Megadril manufactured by Mission Manufacturing Company, Houston, Tex. Use of the shuttle valve on the exhaust function only would improve its performance significantly.

BRIEF DESCRIPTION OF THE PRIOR ART

In the incorporated reference the prior art was discussed in considerable detail; therefore, the discussion of the prior art in the following paragraphs will be limited. Most pneumatically actuated impact drilling tools for rotary drilling use a hammer that impacts against an anvil. Since a high pressure fluid flows through the string of drilling pipe, the high pressure fluid must be alternately used to lift the hammer and, subsequently, to drive the hammer downward against an anvil with the maximum energy possible. Some of the prior art devices contained passages around the hammer that were alternately opened and closed to first communicate the high pressure fluid below the hammer thereby raising the hammer, thereafter dumping the high pressure fluid below the hammer to the bit while simultaneously pressurizing above the hammer to drive it downward.

Other types of impact drilling tools use a center feeder to control the pressurization and depressurization both above and below the hammer. In the incorporated reference, the feeder controls the valving action for (1) pressurization below the hammer (2) pressurization above the hammer and (3) exhaust above the hammer. The remaining function of exhaust below the hammer is controlled by an exhauster located in the anvil. While the incorporated reference was a significant improvement over the prior art, if the pressure above the hammer could be retained for a larger portion of the down stroke of the hammer, the hammer would impact the anvil with a greater force. Likewise, if the exhaust function above the hammer could be maintained for a longer period of time, there would be less resistance to the raising of the hammer. Improving these functions would increase the repetition rate and decrease the amount of pressure necessary for the raising of the hammer.

SUMMARY OF THE INVENTION

The present invention improves the pneumatically actuated impact drilling tool which was previously incorporated by reference. As in the incorporated reference, the hammer reciprocates along the axis of the drilling tool to repeatedly strike an anvil which has a bit on the opposite end thereof. The hammer is repeatedly raised and driven downward by the pressure of a pneumatic fluid flowing through the string of drilling pipe to the impact drilling tool. A feeder extends through a center opening of the hammer and has passages slidably connecting with passages in the hammer. The feeder and hammer control pressurization below the hammer, pressurization above the hammer and exhaust above the hammer. An exhauster located in the anvil controls the exhaust below the hammer. The improvement over the incorporated reference is a shuttle valve slidably connected on the upper portion of the feeder to better control pressurization and exhaust functions above the hammer.

It is an object of the present invention to provide a pneumatically actuated impact drilling tool for rotary drilling wherein pressurization above a hammer element is maintained for the maximum portion of the down stroke to drive the hammmer downward against the anvil.

It is another object of the present invention to provide a shuttle valve telescopically mounted on the feeder that extends through the center portion of the hammer. The shuttle valve is normally located in one of two positions with a first position maintaining for an optimum distance the exhaust above the hammer and the second position maintaining for an optimum distance pressure above the hammer.

It is yet another object of the present invention to provide a shuttle valve on the center feeder tube of a pneumatically actuated impact drilling tool which has a reciprocating hammer located therein. The shuttle valve is operable by a pneumatic fluid flowing through the tool which fluid acts on given pressure areas of the shuttle valve.

It is yet another object of the present invention to provide a novel means for controlling the valving functions of exhaust and pressurization above a hammer of a pneumatically actuated impact drilling tool. The valving functions are performed by a feeder extending through the hammer with a telescoping shuttle valve being located on the feeder. The shuttle valve is first raised to its uppermost position by the high pressure fluid flowing through the feeder, which first position allows a longer exhaust above the hammer. After the hammer raises to a predetermined point, the shuttle valve moves to its lowermost position while pressurization above the hammer is simultaneously occurring. In the lowermost position the shuttle valve maintains the pressurization above the hammer for a longer stroke distance so that pressurization above the hammer will exist through most of the down stroke of the hammer.

This cycle is continually repeated with the hammer delivering full power blows to the anvil and, consequently, to the drill bit for penetrating the earth's formation. Likewise, because exhaust above the hammer is maintained for a longer portion of the up stroke of the hammer, less force is required to raise the hammer.

It is another alternative object of the present invention to provide a shuttle valve for use in the modification of existing pneumatic impact drilling tools. The shuttle valve may control one or more of the pressurization or exhaust functions above or below the hammer, which control will change the effective stroke length of the exhaust and/or pressurization function.

DESCRIPTION OF THE PREFERRED EMBODIMENT

Figure 1A:
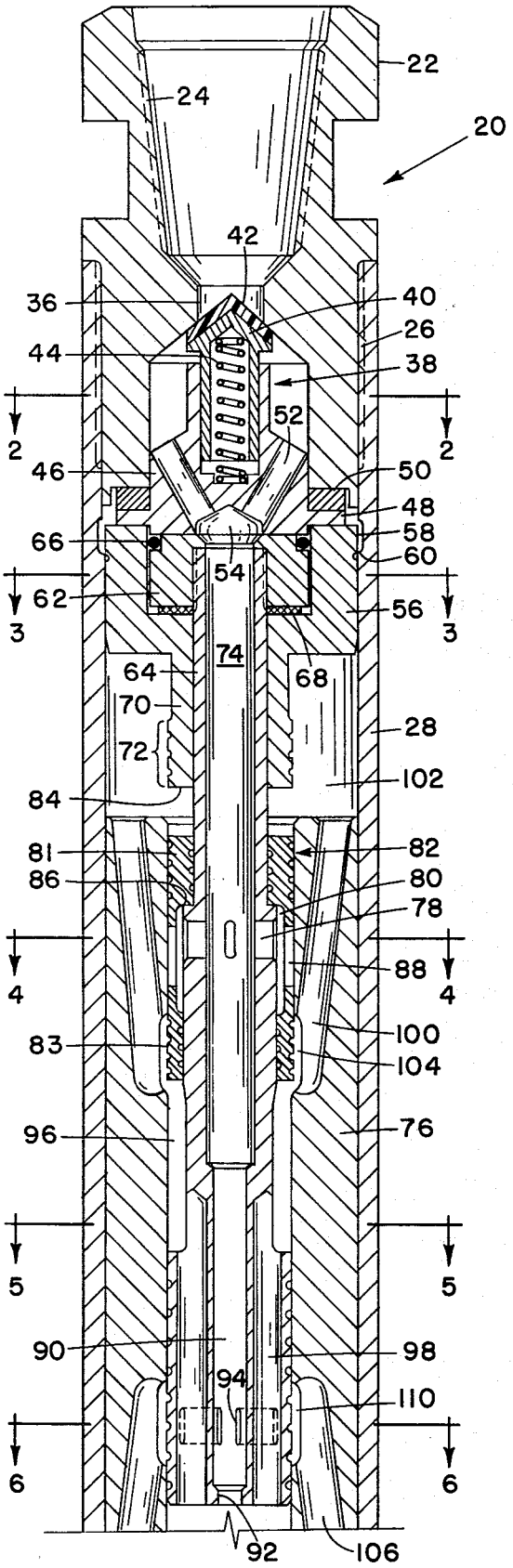
FIG. 1*a* and FIG. 1*b* are elevated sectional views taken along the longitudinal axis of the present invention.
Figure 1B:
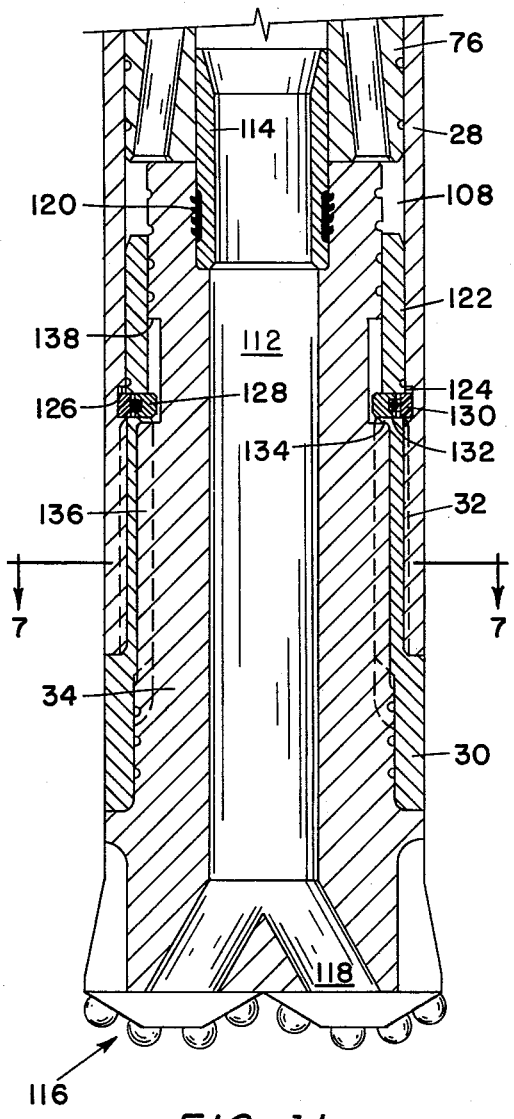

Referring now to FIG. 1*a* and FIG. 1*b* of the drawings, there is shown pneumatically actuated impact drilling tool represented generally by the reference numeral 20. The impact drilling tool 20 connects into a string of drilling pipe (not shown) by means of upper sub 22 and threads 24. Also the upper sub 22 is connected by means of threads 26 to casing 28. The lower portion of casing 28 is connected to lower sub 30 by means of threaded connection 32. The lower sub 30 retains anvil 34 which is telescopically mounted therein a manner as will be subsequently described.

Referring back to the upper sub 22, there is a restriction 36 whereby high pressure fluid from the string of drilling pipe may flow into the impact drilling tool 20. The restriction 36 has a check valve 38 pressing against its lower surface to prevent the reverse flow of the high pressure pneumatic fluid therethrough. The check valve 38 consists of a spring loaded dart 40 with a resilient sealing material 42 (normally rubber) sealing against the restriction 36. Inside of the dart is a coil spring 44 for urging the dart 40 to the closed position as shown in FIG. 1*a*. The coil spring 44 has a small compression force exerted thereon by the dart 40 and valve retaining block 46. The pressure drop across check valve 38 is normally very small when compared to the working pressure of the fluid flowing through the tool 20.

Figure 2:
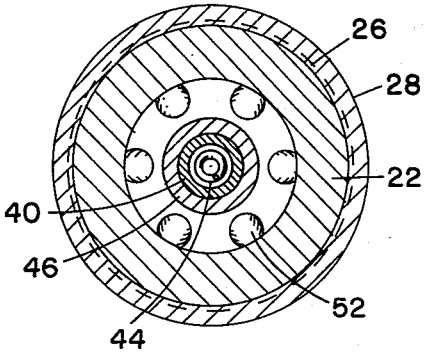
FIG. 2 is a sectional view of FIG. 1*a* taken along section lines 2—2.

The valve retaining block 46 is held in position by flange 48 upon tightening upper sub 22 into position. Seal 50 prevents the high pressure fluid from flowing around flange 48 and valve seating block 46. The high pressure fluid flows through the valve retaining block 46 via sloping passages 52 that converge to center opening 54. A better understanding of the construction of check valve 38 can be obtained by referring to FIG. 2.

Figure 3:
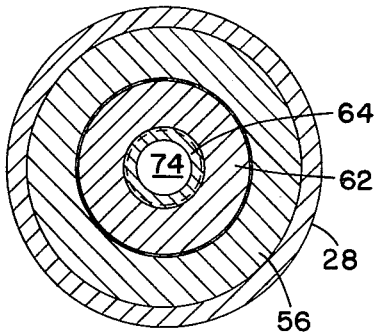
FIG. 3 is a sectional view of FIG. 1*a* taken along section lines 3—3.

The under side of flange 48 abuts against feeder retainer 56. Feeder retainer 56 has a small flange 58 abutting shoulder 60 so that upon tightening upper sub 22 into position, feeder retainer 56 is securely located in position. Inside of the upper portion of feeder retainer 56 is located in a circular nut 62 that is threadedly connected to feeder 64. (See FIG. 3). O-ring 66 prevents the escape of high pressure fluid between circular nut 62 and valve retaining block 46. Also seal washer 68 seals between circular nut 62 and feeder retainer 56. Lower extension 70 of feeder retainer 56 has a leaking seal area 72 the function of which will be subsequently described in more detail.

Figure 4:
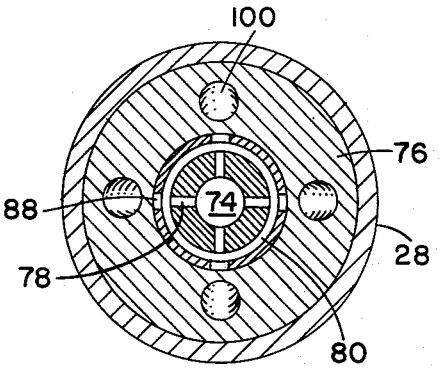
FIG. 4 is a sectional view of FIG. 1*a* taken along section lines 4—4.

The feeder 64 which has a central opening 74 extends downward into the center of hammer 76. Feeder 64 has cross slots 78 for continuous fluid communication between central opening 74 for annulus 80 as defined by a shuttle valve 82. The shuttle valve 82 is slidably mounted on the feeder 64 between end 84 of feeder retainer 56 and shoulder 86 of feeder 64. The upper portion 81 of the shuttle valve 82 slidably seals in a telescoping manner with feeder 64 and hammer 76. The lower portion 83 of the shuttle valve 82 slidably seals against the feeder 64 and the hammer 76. It should be understood and clearly seen from the drawings that the upper portion 81 of shuttle valve 82 defines a large cross sectional area than the lower portion 83 thereof, and, consequently, a larger pressure surface. The annulus 80 is inside of the shuttle valve 82 adjacent to the feeder 64. Slots 88 are formed in the shuttle valve 82 as is more clearly visibile in FIG. 4.

Figure 5:
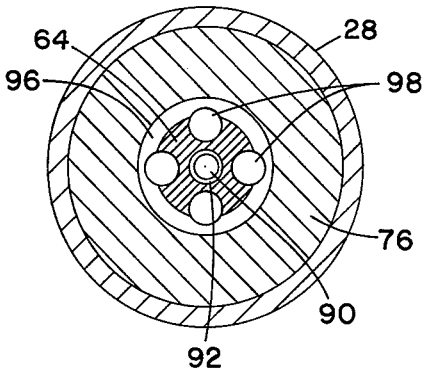
FIG. 5 is a sectional view of FIG. 1*a* taken along section lines 5—5.
Figure 6:
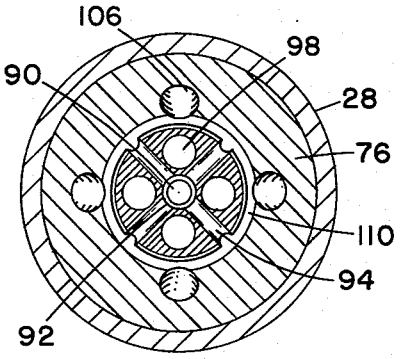
FIG. 6 is a sectional view of FIG. 1*a* taken along section lines 6—6.

The lower portion of the feeder 64 is essentially the same as shown in the incorporated reference. A reduced center bore 90 extends down to restrictive orifice 92. Cross slots 94 give fluid communication between reduced center bore 90 and the central bore of hammer 76. Annulus 96 is defined between feeder 64 and hammer 76. The lower portion of annulus 96 connects to discharge passages 98 in a manner as clearly visible in FIG. 5. It should be understood that the discharge passages 98 do not intersect cross slots 94 as can be seen in FIG. 6.

The hammer 76 is very similar to the incorporated reference with sloping upper passages 100 communicating between an upper pressure chamber 102 and upper undercut 104 of the hammer 76. Likewise, sloping lower passages 106 communicate with lower pressure chamber 108 and lower undercut 110 of hammer 76.

Anvil 34 has a center flow passage 112 wherein high pressure fluid received through exhauster 114 located in the upper portion thereof is discharged to drill bit 116 via passages 118. The exhauster 114 is slidably received into the central opening of hammer 76 and is retained in anvil 34 by resilient material 120.

Figure 7:
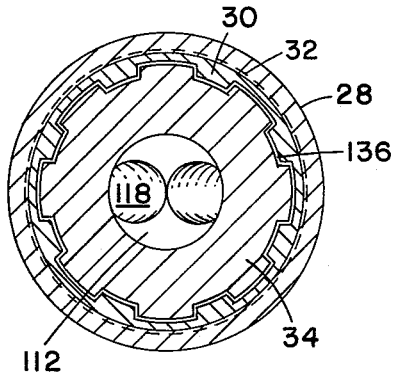
FIG. 7 is a sectonal view of FIG. 1*b* taken along section lines 7—7.

Surrounding anvil 34 is anvil guide ring 122 which is held in position by lip 124 abutting shoulder 126. Immediately below anvil guide ring 122 is located retainer split ring 128. Behind retainer split ring 128 is located resilient material 130 and O-ring 132. When the lower sub 30 is tightened into casing 28 by means of threaded connection 32, inner flange 134 presses against the retainer snap ring 128 to hold it in position. There is a spline connection 136 between the lower sub 30 and anvil 34. It should be understood that anvil 34 can move downward in casing 28 and lower sub 30 until shoulder 138 rests on retainer split ring 128. This would stop the reciprocating action of hammer 76 as was described in the incorporated reference; however, the rotating motion would still be transmitted to the anvil 34 by means of the spline connection 136 as shown in FIG. 7.

METHOD OF OPERATION

Figure 8:
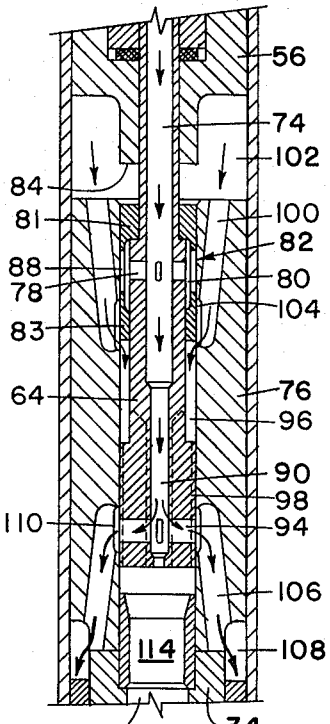

Referring now to the drawings as shown in FIGS. 8 through 12, there is shown a simplified pictorial illustration of the movement of the shuttle valve 82 and hammer 76 along with the fluid flow (normally air) in impact drilling tool 20. FIG. 8 and FIGS. 1*a* and 1*b* illustrate the initial position of the hammer 76 and shuttle valve 82. The high pressure fluid is flowing through central opening 74, cross slots 94 and sloping lower passages 106 to lower pressure chamber 108. This flow of high pressure fluid builds a pressure in lower pressure chamber 108 to begin raising the hammer 76.

Figure 9:
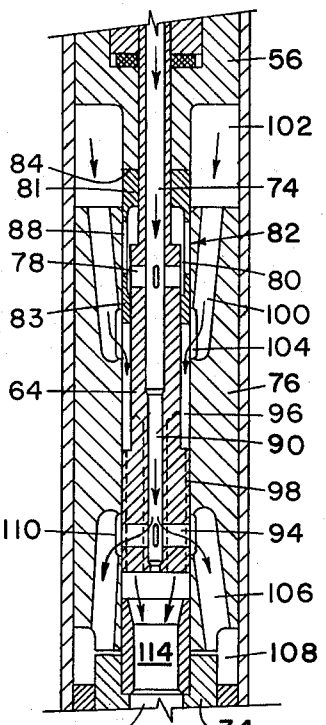

At the same time high pressure fluid is flowing through cross slots 78 to annulus 80 for acting against the upper portion 81 of shuttle valve 82. Simultaneously, the high pressure fluid is acting against lower portion 83 of the shuttle alve 82; however, since the upper portion 81 defines a larger surface area than the lower portion 83, the shuttle valve 82 will rise. Because the shuttle valve 82 is much lighter than the hammer 76 and the weight per activating force ratio is much less for the shuttle valve 82 than in the hammer 76, the shuttle valve 82 will raise to its uppermost position to abut end 84 of feeder retainer 56 before hammer 76 reaches its uppermost position. This position is illustrated by FIG. 9. Referring back to FIG. 8, it can be seen that the upper pressure chamber 102 is in fluid communication with the exhauster 114 via sloping upper passages 100, upper undercut 104 and annulus 96 and discharger passages 98 (see FIG. 1*a*) for dumping any pressurized fluid to the drill bit 116. It can also be seen in FIG. 8 that slots 88 of shuttle valve 82 are located above upper undercut 104. This prevents the high pressure fluid acting on upper portion 81 and lower portion 83 of shuttle valve 82 from reaching the upper pressure chamber 102.

Since the pressure above the upper portion 81 of shuttle valve 82 is much lower than the pressure therebelow, the pressure differential across the upper portion 81 of the shuttle valve 82 will help maintain the shuttle valve 82 in the uppermost postion as shown in FIG. 9. Pressure will continue to build below the hammer 76. By the moving of the shuttle valve 82 to its uppermost position, exhaust from the upper pressure chamber 102 continues as the hammer 76 raises. Pressure in the upper pressure chamber 102 is a much lower pressure than the pressure in annulus 80 of shuttle valve 82. Also the upper portion 81 being larger than the lower portion 83 helps maintain the shuttle valve 82 in its uppermost postion.

Figure 10:
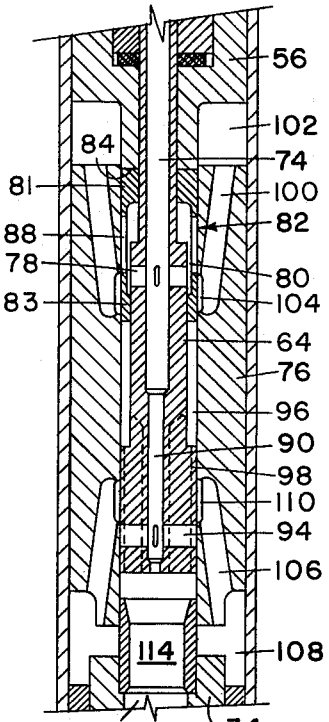

Referring now to FIG. 10, pressurization below the hammer 76 has been terminated by moving the lower undercut 110 above cross passages 94. Also as shown in FIG. 10, upper undercut 104 is in line with the lower tip of slots 88 of shuttle valve 82. Once upper undercut 104 moves in line with slots 88 of shuttle valve 82, pressurization will commence in upper pressure chamber 102. Notice also that the exhaust from upper pressure chamber 102 has been terminated. The pressurized air trapped in lower pressure chamber 108 continues to expand and drive hammer 76 upward.

Figure 11:
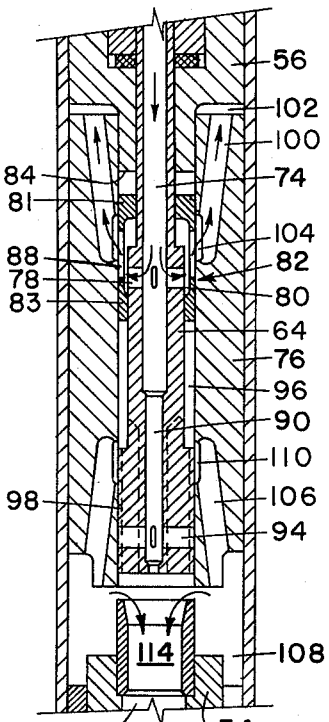

As hammer 86 continues to move upward as shown in FIG. 11, the exhauster 114 slides from the center passage of hammer 76 thereby allowing pressure from lower pressure chamber 108 to be dumped through center flow passage 112 of anvil 34 to the bit 116. Simultaneously, pressurized fluid from central opening 74 of feeder 64 is flowing through cross slots 88, upper undercut 104 and sloping upper passages 100 to the upper pressure chamber 102. Since the pressure on both sides of the upper portion 81 of shuttle valve 82 is now equalizing, the shuttle valve 82 will begin moving downward due to pressure still being exerted on the inside of lower portion 83. The hammer 76 may still be rising.

Referring back to FIG. 1*a*, the leaking seal area 72 prevents the pressure in upper pressure chamber 102 from reaching the upper surface of shuttle valve 82 too rapidly thereby driving the shuttle valve 82 downward with two great a velocity. If shuttle valve 82 is driven downward at a larger velocity, it will have a tendency to fail. While the leaking seal area 72 is specifically designed to slow the downward motion of shuttle valve 82, other types of restrictions may be used to impede the downward movement of the shuttle valve 82. The seal between leaking seal area 72 and hammer 76 should provide sufficient leakage that the shuttle valve 82 will move downward more quickly than hammer 76.

Figure 12:
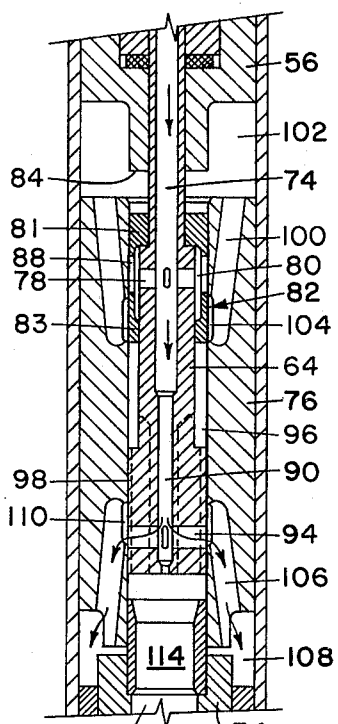
FIGS. 8 through 12 are simplified elevated sectional views showing pictorial illustrations of the reciprocating action of the hammer and shuttle valve and the fluid flow therethrough.

As the hammer 76 moves downward, high pressure fluid communication is maintained with central opening 74 of feeder 64 via cross slots 78, annulus 80, upper undercut 104 and sloping upper passages 100. This high pressure fluid communication with the upper pressure chamber 102 is maintained until immediately prior to impact as shown in FIG. 12. In fact, FIG. 12 shows the position of hammer 76 an shuttle valve 82 at the instant of termination of high pressure fluid communication to upper pressure chamber 102. Notice that pressurization below the hammer 76 has already begun.

By use of the shuttle valve 82 as described and pictorially illustrated in FIGS. 8–12, pressure in the upper pressure chamber 102 can be maintained for a greater portion of the down stroke of the hammer 76. By maintaining the pressure above the hammer 76 for a greater portion of the down stroke, a much greater impact force is delivered by the hammer 76 to the anvil 34. Also, by maintaining the exhaust with the upper pressure chamber for a longer portion of the upstroke of the hammer 76 as was previously described, it takes less energy to raise the hammer 76 to its uppermost position. As the hammer 76 strikes anvil 34, the cycle is repeated, starting again with FIG. 8.

ALTERNATIVE EMBODIMENT

The shuttle valve as explained in prior portions of the specification may not only be used with the incorporated reference of Bassinger (U.S. patent application Ser. No. 507,968), but may also be used on many other types of pneumatic impact drilling tools that are commonly sold in the market today. Using a typical example, the Megadril manufactured by Mission Manufacturing Company of Houston, Tex., may be modified to include the shuttle to control some of its valving functions. Enclosed in an advertising brochure of the Megadril for the examiner to consider in conjunction with the subsequently described alternative embodiment. Since the present modification only affects one portion of the Megadril, only that portion will be shown with other portions of the Megadril being shown in the attached advertising brochure.

Figure 13:
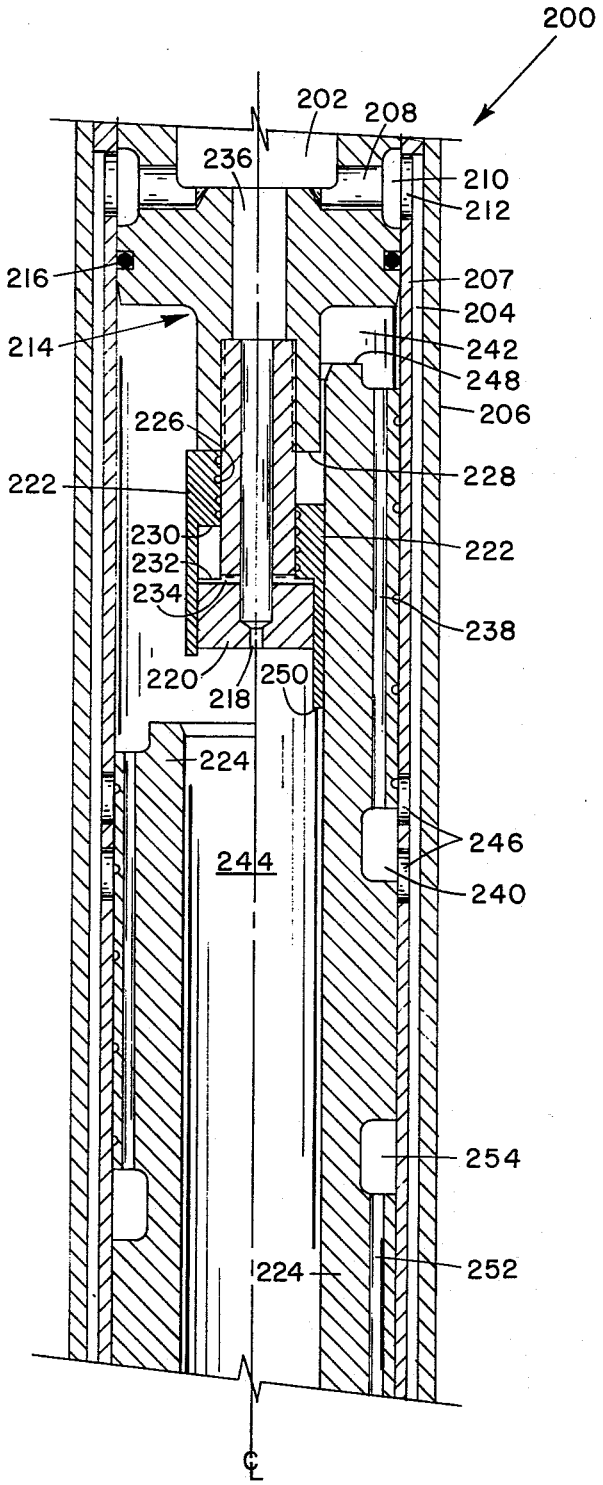
FIG. 13 is an elevated sectional view of an alternative embodiment taken along the longitudinal axis to modify an existing center exhaust type impact drilling tool.

Referring now to the drawing shown in FIG. 13, there is shown a partial elevational section view of an alternative embodiment of the present invention designated generally by the reference numeral 200. Compressed air from the surface enters the alternative embodiment 200 through chamber 202 and feeds to annulus 204 in casing 206 via holes 208 and undercut 210 of stationary upper exhauster 214 and openings 212 of innermost cylindrical portion 207 of casing 206.

The modification of the Megadril as shown in the alternative embodiment 200 is contained in the stationary upper exhauster 214. The stationary upper exhauster 214 has the air choke 218 located at the bottom thereof to allow a small amount of bypass air to continually flow through the tool (see advertising brochure). Threadably connected at the bottom of the stationary upper exhauster 214 to form an integral part thereof is a flanged extension 220 which includes the air choke 218.

FIG. 13, which is divided along centerline ( ), shows different positions for a shuttle valve 222 and hammer 224 on the left of the than is shown on the right of the . This is used to illustrate different positions of both the shuttle valve 222 and hammer 224.

Referring specifically to the shuttle valve 222, a sliding seal is maintained between the upper portion of shuttle valve 222 and flanged extension 220 by metal-to-metal seal 226. The top of shuttle valve 222 abuts shoulder 228 of stationary upper exhauster 214 when the shuttle valve 222 is in its uppermost postion. When shuttle valve 222 is in its lowermost position, shoulder 230 abuts flange 232 of flanged extension 220. Connection to the area defined between flange 232 and shoulder 230 are cross passages 234 that continually feed pressurized air thereto via center flow passage 236 of stationary upper exhauster 214 and flanged extension 220.

Refering now to the hammer 224, there are upper pressure passages 238 connecting the top of hammer 224 with undercut 240. The upper pressure passages 238 are used to pressurize the upper chamber 242 of the alternative embodiment 200. Also, the hammer 224 has a center exhaust passage 244. Lower pressure passages 252 connect undercut 254 with the bottom of hammer 224 as can be seen in detail in the advertising brochure.

Without going into a detailed description of remaining portions of the alternative embodiment 200, all of which can be seen in the enclosed advertising brochure for the Megadril, the alternative embodiment 200 will function basically as explained herein below. High pressure air enters the alternative embodiment 200 through chamber 202. From chamber 202 the high pressure air will feed through holes 208, undercut 210 and openings 212 into the annulus 204 of the casing 206. When the hammer 224 is in its lowermost position as shown to the left of the , the high pressure air will feed through the annulus 204 to a position below hammer 224 (not shown in FIG. 13). The same pressure is feeding through center flow passage 236 and cross passage 234 to raise the shuttle valve 222 to its uppermost position as shown to the left of the .

The pressure below the hammer 224 will cause the hammer 224 to rise to its uppermost position as shown to the right of the . As undercut 240 becomes tangent to openings 246 in innermost cylindrical portion 207 of casing 206, the pressure in annulus 204 will flow through the opening 246, undercut 240 and upper pressure passages 238 to pressurize upper chamber 242. The pressurization of upper chamber 242 will stop the upward movement of hammer 224. Simultaneously, as the pressure in upper pressure chamber 242 pushes against the top of shuttle valve 222 which defines a larger pressure area than shoulder 230 which is continually pushed against by pressure in center flow passage 236, shuttle valve 222 will move to its lowermost position as shown to the right of the when a certain pressure is reached in upper chamber 242.

Now the pressure trapped in upper chamber 242 will drive the hammer 224 downward against the anvil (not shown) in a manner typical for impact drilling tools. The pressurized air trapped in upper chamber 242 will continue to expand, driving the hammer 224 downward even after undercut 240 has passed openings 246 to annulus 204. It is only immediately prior to impact by the hammer 224 against the anvil that the top 248 of hammer 224 clears the bottom 250 of shuttle valve 222. This insures that the driving force is being applied to the hammer 224 essentially the entire distance of its downward stroke. As soon as the top 248 of the hammer 224 clears the bottom 250 of shuttle valve 222 (which is immediately prior to impact) the upper chamber 242 will exhaust through center exhaust passage 244 to the drill bit (not shown). Because there is no longer any pressure exerted against the top of shuttle valve 222, the pressure exerted against shoulder 230 will immediately raise the shuttle valve 222 to its uppermost position shown to the left of the . Now the cycle may be repeated with pressure below the hammer 224 again causing the hammer 224 to rise. Exhaust below hammer 224 has not been explained as part of the alternative embodiment 200, but can be clearly seen from the incorporated advertising brochure. All of the exhaust functions below the hammer 224 are located below the partial sectional view shown in FIG. 13.

It should be appreciated that the shuttle valve 222 only controls one of the valving functions in the alternative embodiment 200; specifically, the exhaust from the upper chamber 242. However, the shuttle valve 82 as explained in conjunction with FIGS. 1 through 12 controls both the pressurization and exhaust of the upper pressure chamber 102. The shuttle valve may be used in many alternative embodiments to control the point of pressurization or exhaust either above or below a hammer and thereby improve the efficiency of an impact drilling tool. By the use of the shuttle valve 222 in the alternative embodiment 200, the efficiency of the impact drilling tool illustrated therein can be increased by approximately 30% - 40%. The key to the use of any shuttle valve is to maintain the driving force as long as possible on the hammer, while simultaneously minimizing any force that would tend to impede the downward or upward movement of the hammer.

I claim:

1. In an impact drilling tool for operation by high pressure fluid comprising a casing, an upper sub connected to said casing for connection to a string of drilling pipe, anvil means slidably positioned in a lower end of said casing, bit means located below said anvil means, hammer means slidably positioned in said casing for periodically impacting said anvil means, feeder means in said casing extending downward into an opening of said hammer means adapted to receive high pressure fluid from said drillng pipe, upper cross passages in said feeder means periodically communicating said high pressure fluid from a center flow passage through said hammer means to an upper pressure chamber, lower cross passages in said feeder means periodically communicating said high pressure fluid from said center flow passage through said hammer means to a lower pressure chamber, the improvement comprising:

shuttle valve means surrounding said upper cross passage of said feeder means, said shuttle valve means having shuttle passages therethrough maintaining communication with said upper cross passages, said shuttle valve means being movable along said feeder means between a first and second position to provide periodic communication between the shuttle passages and the upper pressure chamber, and said shuttle valve means being movable preceding like movement of said hammer means, with communication through said upper cross passage with said upper pressure chamber being maintained through said shuttle passages for a substantially extended portion of a downstroke of said hammer means.

2. An impact drilling tool according to claim 1 wherein exhaust from said upper pressure chamber is maintained between said shuttle valve means and said hammer means for a substantially extended portion of an upstroke of said hammer means, said first position of said shuttle valve means extending said exhaust from said upper pressure chamber and said second position of said shuttle valve means extending said pressurization of said upper pressure chamber.

3. An impact drilling tool according to claim 2 wherein said shuttle valve means has first and second differential surface areas with said shuttle passage being located therebetween, said differential surface areas being acted upon by said high pressure fluid to move said shuttle to said first position until exhaust from said upper pressure chamber has been completed by moving said hammer means a first predetermined distance upward.

4. An impact drilling tool according to claim 3 wherein pressurization of said upper pressure chamber acts against said first and second differential surface areas to lower said shuttle valve means to said second position thereby maintaining pressurization of said upper pressure chamber until said hammer means has moved downward a second predetermined distance.

5. An impact drilling tool according to claim 1 wherein said feeder means includes a retaining means held in said casing means by said upper sub, said retaining means including seal means to prevent said high pressure fluid from leaking therearound.

6. An impact drilling tool according to claim 5 wherein communication of said high pressure fluid to said differential pressure areas is restricted to prevent a rapid downward movement of said shuttle valve means.

7. A feeder for an impact drilling tool for controlling flow of a high pressure fluid to an upper pressure chamber above a hammer and a lower pressure chamber below the hammer, said feeder being adapted to be positioned inside an opening of said hammer with upper hammer passages communicating between said opening and said upper pressure chamber and lower hammer passage communicating between said opening and said lower pressure chamber, said feeder comprising, an elongated body portion having a center flow passage therethrough for receiving said high pressure fluid;

a shuttle valve surrounding said feeder;

upper cross passages for communicating between said center flow passage and said shuttle valve;

lower cross passages for communicating between said center flow passage and said lower pressure chamber via said lower hammer passage when said hammer is in its lower position;

said shuttle valve having an upper surface and a lower surface for slidably between said feeder and said hammer, shuttle passages between said upper and lower surface for periodically communicating said high pressure fluid from said upper cross passages to said upper pressure chamber via said upper hammer passages, and said upper and lower surfaces being of a size and shape such that application of high pressure fluid thereto moves said shuttle valve to an up position and down position faster than said hammer moves up and down.

8. A feeder according to claim 7 which includes an annular space between said upper cross passage and said shuttle passage.

9. A feeder according to claim 8 wherein said up position of said shuttle valve maintains an exhaust connection to said upper pressure chamber until said hammer moves up a predetermined distance.

10. A feeder according to claim 9 wherein said shuttle valve begins communicating said high pressure fluid via said shuttle passage and upper hammer passages to said upper pressure chamber while said hammer moves up a second predetermined distance, simultaneous with pressure in said upper pressure chamber acting on said upper surface and said lower surface to move said shuttle valve to its down position.

11. A feeder according to claim 10 wherein said down position of said shuttle valve maintains high pressure communication to said upper pressure chamber until said hammer moves down a third predetermined distance.

12. A feeder according to claim 10 which includes restriction means to delay reaction of said high pressure fluid on said upper surface thereby slowing downward movement of said shuttle valve.

13. A pneumatic percussion drilling tool comprising a casing, a bit extending below said casing and slidably mounted therein and having anvil means at the upper end thereof, hammer means slidably positioned in said casing for reciprocal movement into and out of contact with said anvil means, a passage for introduction of fluid under pressure into said casing, a plurality of passages in said tool and said hammer means cooperable to direct fluid under pressure to and from alternate ends of said hammer means to move the same reciprocally relative to said anvil means, said hammer means being operable upon movement to provide a valving action controlling the flow of fluid through said tool, and valving means in said tool movable independently of said hammer means and relative to at least a first one of said passages to vary the effective location of valving action by said hammer means to effect the application of fluid pressure to said hammer means for substantially extended portions of the movement thereof.

14. A pneumatic percussion drilling tool according to claim 13 wherein said valving means is slidably received in a second one of said passages located within said hammer means, said valving means maintaining pressurization above said hammer means.

15. A pneumatic percussion drilling tool according to claim 14 wherein said valving means is slidably mounted on an exhauster means attached to said casing, and said valving means varying the location of the valving action which controls exhaust from above said hammer means.

16. A pneumatic percussion drilling tool according to claim 13 wherein said hammer means includes a third of said passages therethrough, and said valving means being slidable with respect to said third passage to vary the effective location of the valving action which controls fluid flow through said third passage.

17. A pneumatic percussion drilling tool according to claim 16 wherein said valving means has at least two pressure surfaces of different areas, a first of said pressure surfaces in continual communication with the fluid received in said casing, a second of said pressure surfaces in continual communication with fluid above said hammer means, and the differential of force exerted by pressures of said fluid acting on said first and said second pressure surfaces controlling movement of said valving means.

* * * * *